United States Patent [19]

Klaren

[11] 4,403,650

[45] Sep. 13, 1983

[54] APPARATUS FOR FLOW OF A LIQUID MEDIUM

[75] Inventor: Dick G. Klaren, Hillegom, Netherlands

[73] Assignee: Esmil BV, Amsterdam, Netherlands

[21] Appl. No.: 319,322

[22] Filed: Nov. 9, 1981

[30] Foreign Application Priority Data

Nov. 12, 1980 [NL] Netherlands ..... 8006161

[51] Int. Cl.[3] ..... F28D 13/00

[52] U.S. Cl. ..... 165/104.16; 165/108; 165/40; 34/57 A; 422/146; 422/139; 422/145

[58] Field of Search ..... 165/104.16, 108, 40; 34/57 A; 122/4 D; 422/139–147; 134/104, 105, 111; 159/DIG. 3, 16 R; 110/245

[56] References Cited

U.S. PATENT DOCUMENTS

| | | | |
|---|---|---|---|
| 2,488,406 | 11/1949 | Hirsch | 422/146 X |
| 2,745,725 | 5/1956 | Ward et al. | 422/147 X |
| 3,505,111 | 4/1970 | Maleb | 159/DIG. 3 |
| 3,642,452 | 2/1972 | Roget et al. | 165/108 X |
| 4,035,152 | 7/1977 | Yang et al. | 34/57 A X |
| 4,246,231 | 1/1981 | Figler et al. | 422/147 |
| 4,296,800 | 10/1981 | Johnson | 165/104.16 X |

*Primary Examiner*—Albert W. Davis, Jr.

*Attorney, Agent, or Firm*—Stevens, Davis, Miller & Mosher

[57] ABSTRACT

In apparatus for flow of a liquid medium e.g. a heat exchanger the liquid flows through a plurality of parallel vertical pipes 10 from a bottom chamber 4 to a top chamber 5. The apparatus contains a mass of particles which are fluidized in the pipes by the flow of liquid. In order to allow a higher speed of liquid flow, giving the apparatus greater capacity transfer means 11,12,13,14 are provided to convey the particles batchwise from the top chamber to the bottom chamber. This transfer corrects the tendency of the higher flow speed to carry the particles into the top chamber. Suitably the transfer means is a lock chamber 11 with linked inlet and outlet valves 12,13.

16 Claims, 4 Drawing Figures

APPARATUS FOR FLOW OF A LIQUID MEDIUM

BACKGROUND OF THE INVENTION

1. Field of the Invention

The invention relates to apparatus for flow of a liquid medium, for example a heat exchanger, having a plurality of parallel vertical pipes the bottom and top ends of which open into a bottom chamber and a top chamber respectively, for supply and discharge respectively of the medium, mass of particles fluidisable by the flowing medium being present.

2. Description of the Prior Art

Apparatus of the type described above is illustrated for example in U.K. patent Specification No. 1,592,232. Such apparatus can be very effectively used for performing physical and/or chemical processes and is especially useful as a heat exchanger. The medium flowing through the pipes is in this case one of the heat exchanging media, e.g. water, and the pipes are surrounded by the other medium.

The known apparatus is operated so that the granular mass (or mass of particles) in the pipes and the top and bottom chambers is fluidised without the mass being carried as a whole in the direction of the flow of the medium. An operating state is also sought in which the particle movement in each of the parallel pipes is virtually identical, so that the particles are not carried from the one pipe into another pipe. This stationary operating state results in appreciably better heat transfer and therefore to a greater capacity of the apparatus as a heat exchanger. The light scouring effect of the particles on the pipe walls also has a cleaning effect, whereby the risk of dirtying e.g. with boiler scale, is greatly reduced.

A limitation of the known apparatus is that the speed of flow of the medium may not be so great that the particles are carried off through the medium discharge. As a consequence of the improved heat transfer rate achieved by the presence of the particle mass, a lower flow speed of the medium means that, under certain circumstances, the desired heat transfer can be achieved in shorter pipes, but in order to obtain a sufficiently high flow capacity the number of parallel pipes must be large. This may lead to large diameters of the pipe plates which hold the pipes and much costly drilling work in order to prepare these pipe plates.

SUMMARY OF THE INVENTION

The object of the present invention is to provide apparatus in which the number of parallel pipes is reduced while the same flow capacity and the same heat transfer rate are retained.

According to the invention, the apparatus described initially has transfer means adapted to transfer the particles batchwise from the top chamber to the bottom chamber, without creating, in the transfer means, a direct connection between the top and bottom chambers. The transfer means may be called a lock system, i.e. a transfer path having valve means to achieve the desired batch transfer without establishing a short circuit for the medium flowing upwardly through the pipes.

The operating principle of this transfer means is that the stationary operating state is replaced by a quasi-stationary one. This means that some carriage of the particles from the bottom chamber to the top chamber by the flow of the medium in the pipes is permitted, although at a very much lower speed than the speed of the medium. The particle mass thus accumulating in the top chamber is periodically returned in batches via the transfer means to the bottom chamber without a short circuit for the liquid medium arising between the top chamber and the bottom chamber. This process allows operation at appreciably higher speeds of the flowing medium, which means, for the same flow capacity, a corresponding reduction in the number of pipes required. It should be noted that it is particularly important that no short circuit of the medium flow can take place through the transfer means since this would have very detrimental consequences to the heat transfer.

The high speed of the flowing medium which can be achieved with the invention will usually be sufficient to create a gentle fluidised state in the top chamber with a distinct upper surface of the fluidised bed. At higher speeds for the medium however, it may be difficult to prevent the particles being carried off through the discharge with the medium. In that case, satisfactory operation can nevertheless be obtained if a particle separator, e.g. a cyclone, is present in the discharge between the top chamber and the transfer means, the transfer means being connected by the separator to the discharge from the top chamber.

Essential to the operation of the transfer means is that sufficient quantities of particles may be transported from the top chamber to the bottom chamber without a short circuit in the medium flow. This can be achieved, for example, with the aid of a cellular gate system. Cellular gate systems are devices known in themselves and may be for example of the rotating cell type. A cell is periodically filled with particles dropping into them from the top chamber, after which the cell is transported to a place where it is in open connection with the bottom chamber so that the particles can then drop into the bottom chamber.

For the present purposes, however, there is a preference in many cases for a transfer means which includes at least one valve passage having first and second valves defining a lock chamber, the first valve being openable to allow particles from the top chamber into the lock chamber and the second valve being openable to allow the particles to pass from the lock chamber to the bottom chamber. Suitably, these valves have conical valve members which taper towards each other. By opening and closing these valves periodically and alternately, the particles can move into the lock chamber when the first valve is open after which the particles can move into the bottom chamber when the first valve has been closed and the second valve is opened. When transfer means of large capacity is desired, it may be preferable to have more than one lock chamber.

With transfer means of limited capacity for apparatus of relatively small dimensions, an effective design may be obtained if one or several lock chambers extend among the pipes. The particle return system will then as it were, form part of the pipe assembly. In larger installations, and in installations where it is desirable for the return system to be more accessible, it is preferable for the lock chamber or chambers to extend outside or away from the pipes. These lock chambers can then be fitted entirely outside the heat exchanger as a whole. This arrangement may also be useful if an existing apparatus is to have its capacity enlarged by the addition of the transfer means.

It may also be important for effective operation to select suitable points on the upper chamber and the bottom chamber respectively for connection of the transfer means. A transfer passage may open into the top chamber together with the pipes through a pipe plate but better control of the process may be obtained if the transfer means is connected at the top to a point above the level where the pipes open, and to the bottom chamber at a point at or near to the lower level of the fluidised particle mass in the bottom chamber during operation. If, in fact, the connection points are at the boundary levels of the fluidised mass both in the bottom chamber and in the top chamber, a virtually quasi-stationary state is obtainable for the fluidised mass throughout the apparatus.

The invention can be applied particularly advantageously if the apparatus is provided with a horizontal distribution plate in the bottom chamber. An arrangement of such a distribution plate in the bottom chamber above which the particle mass remains has previously been described. This distribution plate serves not only as a support for the particle mass but also aids the even distribution of the flowing medium towards the various pipes. However, in the invention, the distribution plate may be provided with openings which are larger than the dimensions of the particles and the transfer means may be connected to the bottom chamber below the distribution plate. The particle mass is thus returned beneath the distribution plate and the upward movement of the mass towards and through the pipes is now evenly distributed by the distribution plate. A highly uniform fluidised bed can be obtained above the distribution plate and, in consequence, even distribution of the flowing medium and particles over all the pipes. Since the scouring effect of the granules now also extends to the openings of the distribution plate dirtying e.g. biological pollution can effectively be prevented.

Finally, with this arrangement, the regularity of the particle flow can be improved because the pressure difference across the transfer means is increased by the additional contribution of the distribution plate. This greater pressure drop can lead to more accurate control over the operation of the transfer means. In order, then, to prevent the particles entering the liquid medium supply opening, it is recommended that the supply is fitted in the bottom of the bottom chamber and is connected to the interior of the chamber via a labyrinth. If the labyrinth is of symmetrical design, the flowing medium may already be distributed well over the bottom chamber.

If the transfer means is designed with two valves at the ends of a lock chamber, the valves can be operated independently. The operating systems for the two valves can alternatively be coupled to each other, so that they can be moved simultaneously. A very simple design can be obtained, however, by coupling the valves mechanically to each other by means of a valve rod extending through the lock chamber. An external drive can then be omitted. If suitably dimensioned and arranged, the coupled set of the two valves will be kept pressed upwards by the fluid pressure keeping the upper valve open, so that the particles gradually collect in the lock chamber. When the joint weight of the valves, the valve rod and the particles within the lock chamber exceeds the upward pressure on the bottom valve, the bottom valve will open so that the top valve closes. The lock chamber then remains closed to liquid flow, but the particles collected in the lock chamber can drop into the bottom chamber. The initial state is then re-established and the cycle repeats.

Since the particles which collect in the lock chamber originate from the top chamber, their temperature will be higher than that in the immediate surroundings of the lock chamber if the apparatus is used as a heat exchanger. If the transfer means is located away from the pipes this may lead to unnecessary loss of heat and a reduction in the efficiency of the apparatus. These difficulties may be countered by insulating the or each lock chamber from its environment. This insulation can be achieved by building the lock chamber from an insulating material or providing it with a lining or by making it double-walled.

The particle mass which collects in the lock chamber is not fludised and may therefore tend to jam when moving down, but this can be very simply avoided by making the or each lock chamber widen slightly downwardly.

It will be clear that there is considerable freedom in the choice of the material for the lock chamber and for its inner surface, as long as such material is chemically and/or physically proof to the operating conditions. Depending on the nature of the medium and of the particles, it will usually be possible to find a material for the internal surface of the lock chamber which greatly reduces the adhesion of polluting material to that surface.

BRIEF INTRODUCTION OF THE DRAWINGS

Embodiments of the invention will now be described by way of non-limitative example and with reference to the accompanying drawings. In the drawings.

DESCRIPTION OF THE PREFERRED EMBODIMENTS

Figure 1:
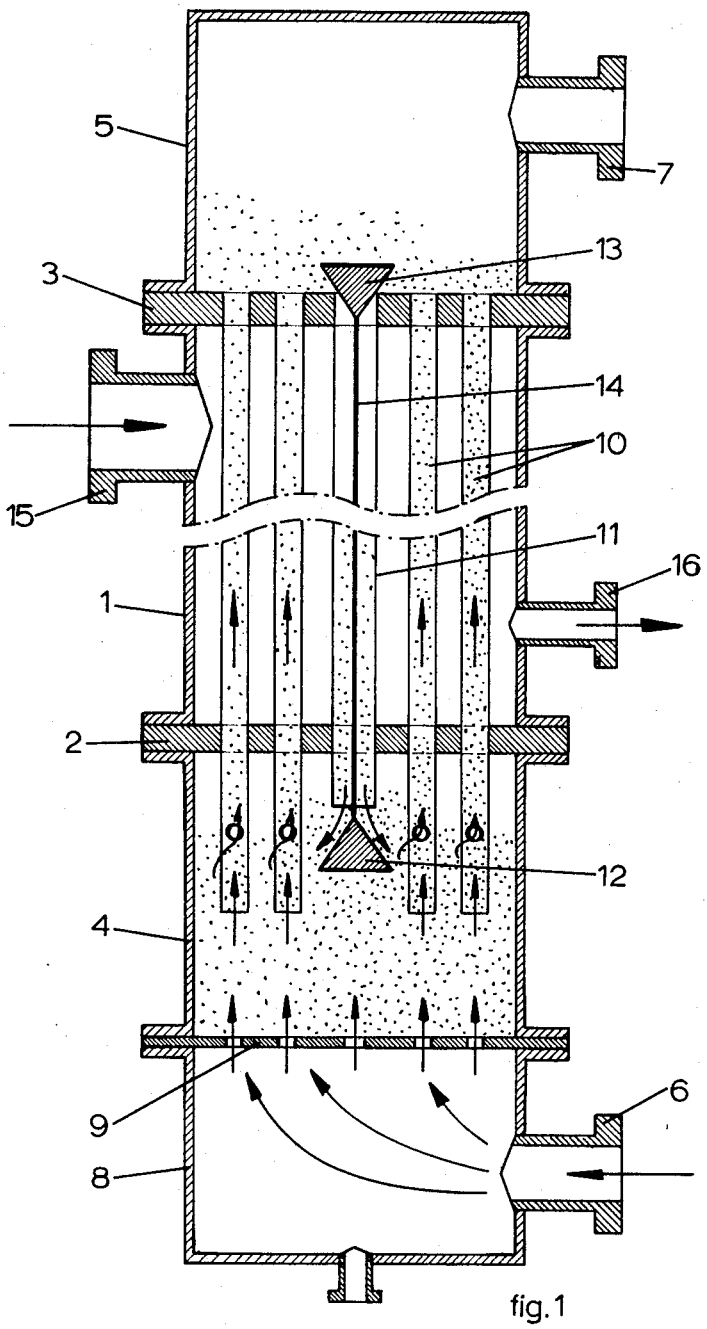
FIG. 1 is a vertical sectional view of a first embodiment of the invention having an internal lock chamber.

All the embodiments of the invention illustrated are heat exchangers, and the same reference numerals are used to denote corresponding parts in the various drawings.

Referring to FIG. 1 there is shown a cylindrical housing 1 which is closed by pipe plates 2 and 3, to which a bottom box 4 and a top box 5 are attached. A supply pipe 6 opens into a lower box 8 which forms a downward extension of the bottom box 4, and a discharge pipe 7 is connected to the top box 5. The lower box 8 is separated from the bottom box 4 by a distribution plate 9. The distribution plate 9 is provided with bores which do not allow a particle mass located in the bottom box 4 to pass through it.

The bottom and top boxes 4,5 are joined to each other by means of a bundle of parallel vertical pipes 10 and a lock passage 11 which are fixed in the pipe plates 2 and 3 and open at their respective upper and lower ends into the top and bottom boxes. In operation, a liquid medium, e.g. water, passes as a first heat-exchanging medium through the supply 6, lower box 8, distribution plate 9, bottom box 4, pipes 10, top box 5, and discharge 7. A second heat-exchanging medium passes via a supply pipe 10 into the housing 1 and then flows among pipes 10 before leaving the housing 1 via the discharge 16.

As the first medium flows through the bottom box 4 the mass of particles present in it is fluidised and expands through the pipes 10 into the top chamber 5, to form a fluidized bed occupying at least the pipes. This bed greatly enhances the heat-exchanging efficiency and has previously been described.

Two conical valve members 12 and 13 which are directly connected to each other by a valve rod 14 are located near to the respective ends of the lock passage 11 with the conical apexes directed towards each other. These valve members seat on the ends of the passage 11 to form upper and lower valves. The distance between the valve members is slightly greater than the length of the lock passage 11 so that the passage 11 cannot be closed at both ends.

The assembly of valve members 12,13 and rod 14 is pressed upwards during operation by the pressure difference in the first medium between the bottom box 4 and the top box 5, so that the lower valve 12 closes the lock passage 11 while the top end of the lock passage is open. Some of the particles fall into the lock passage 11 past the open valve member 13 and the lock passage begins to fill up. When the combined weight of the valve assembly and the particles in the lock passage exceeds the external force exerted on the valve assembly by the pressure difference between the bottom and top boxes, the valve assembly moves down so that the top end of the lock passage is closed off. The particles from the lock passage 11 then fall into the bottom box 4, and the initial state is then restored. The cycle then repeats itself.

As a result of this periodic transfer of particles in batches from the top box to the bottom box the first medium can now be allowed to flow through the pipes at such a flow rate that the particles are carried in the pipes 10 from the bottom box to the top box. This gives the advantages described above. It will be seen that the simple transfer means constituted by the passage 11 and valve assembly 12, 13, 14 does not create a short circuit for the first medium by-passing the pipes 10.

Various possible changes of the design illustrated in FIG. 1 which need not be further illustrated will now be mentioned. For example, the valves of the lock passage can be driven from outside in combination or separately, where there is a special need to do so. The lock passage 11 may, further, widen slightly downwards, so the particle mass can flow out of it more quickly. The choice of materials for this passage 11 may be adapted to the requirements of improved thermal insulation of the channel or for avoiding the growth of impurities. As already described above, these features are achievable by suitable choice of the material for the passage 11 itself or by selecting a suitable lining material for the interior of the passage. The insulation can also be improved by making the channel double-walled.

Figure 2:
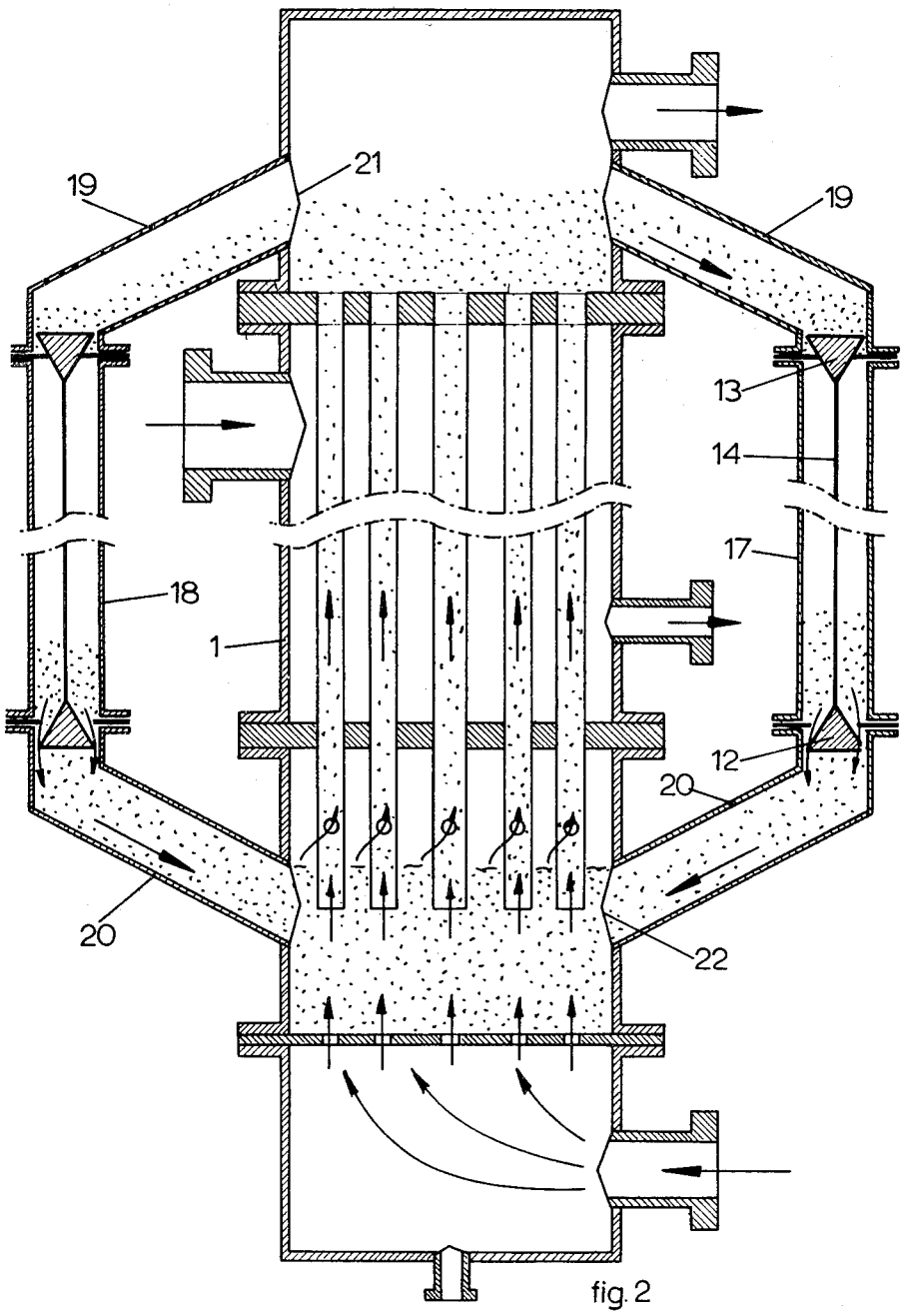
FIG. 2 is a similar view of a second embodiment of the invention having external lock chambers.

FIG. 2 shows an embodiment similar to that of FIG. 1 except that the transfer passage for the particles does not extend among the pipes 10 as in FIG. 1 but outside the cylindrical wall 1. In this drawing, two transfer means are shown, with lock chambers 17 and 18 respectively. The lock chambers 17,18 are defined by valve arrangements 12,13 similar to the valves of FIG. 1 and are connected to the top and bottom boxes by passage portions 19 and 20 which run diagonally and connect into the boxes 5,4 at points 21 and 22 respectively. The location of the connected points 21 and 22 is chosen to match the levels of the top and bottom surfaces of the fluidized bed of particles in the boxes 5 and 4 during operation. In this way, a uniform location of these levels is achieved and the transfer means scarcely affect smooth operation, even with the periodic opening and closing of the lock chambers. Instead of two lock passages as shown, a single lock passage or even a whole row of lock passages around the apparatus can be employed. The transfer means of FIG. 2 can be fitted to existing installations in order to increase their capacity to transfer heat.

It will be clear to an expert that the lock chamber design with the valves of the kind shown can be replaced by a cellular lock system operating vertically, of a known design. This would have to be driven externally.

Figure 3:
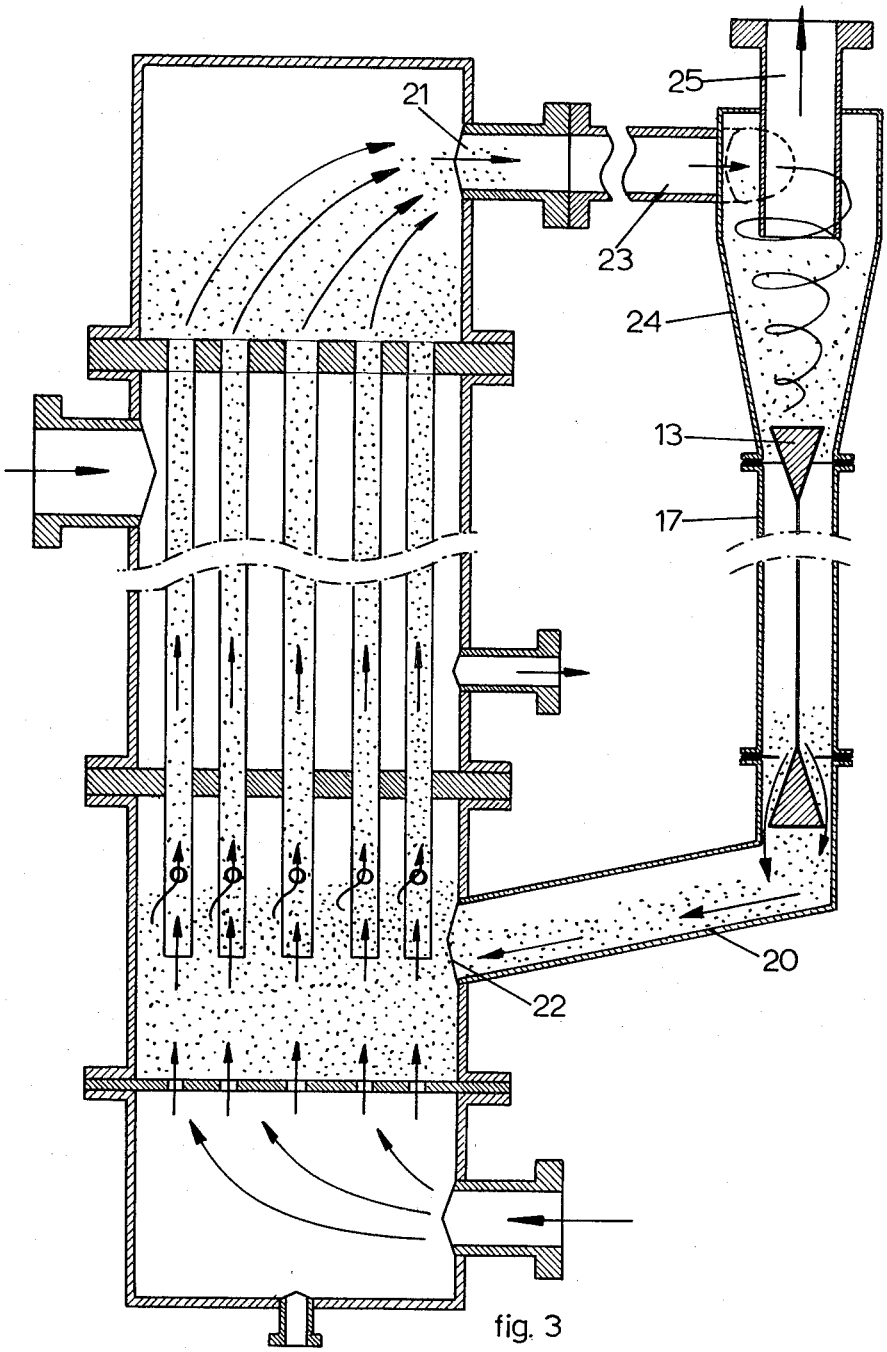
FIG. 3 is a vertical sectional view of a third embodiment employing a cyclone.

FIG. 3 shows an embodiment which is a variation of that of FIG. 2 and is particularly useful if the rate of particle movement through the apparatus increases so much that there might be a risk of particles being carried to the outside by the medium flow. For this purpose, the connection point 21 of the transfer system is combined with the discharge 7 from the top box 5. A cyclone 24 is located in the discharge 7, connected by a pipe 23 to the box 5. The particles fall from the cyclone 24 into the lock chamber 17 when the upper valve 13 is in open position. The liquid medium is discharged via a pipe 25 from the cyclone 24.

Figure 4:
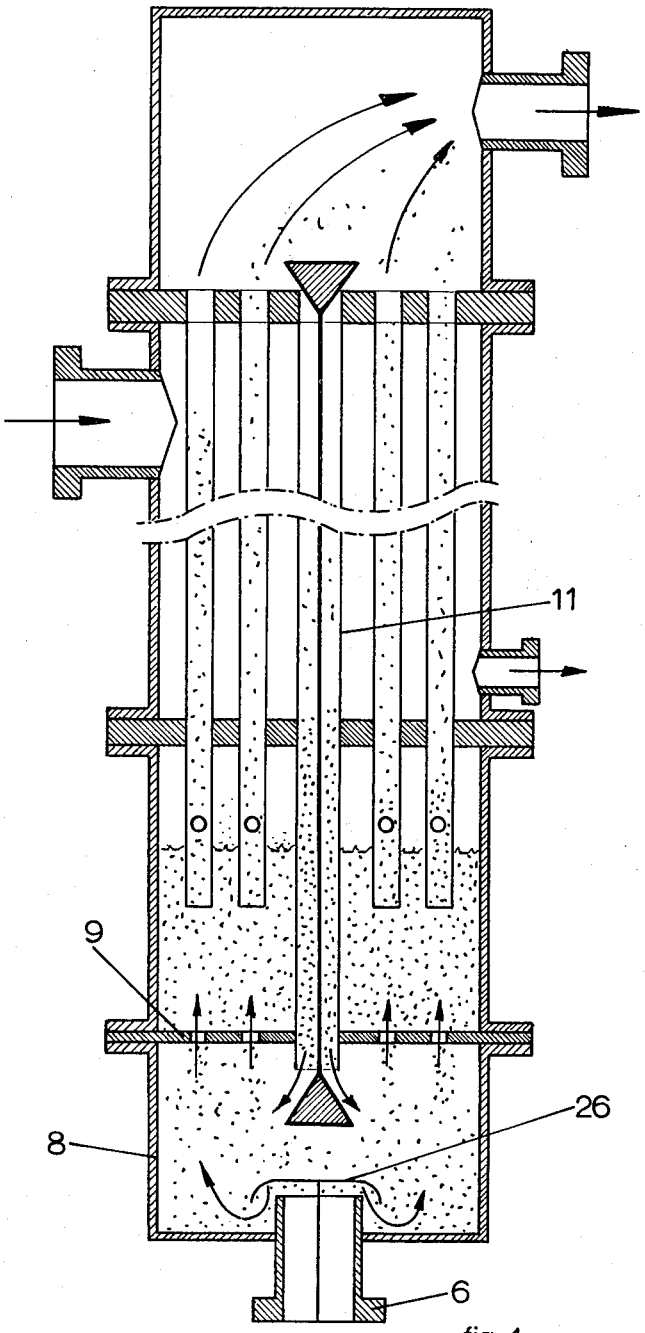
FIG. 4 is a similar view of another embodiment which is a slight modification of the apparatus of FIG. 1.

FIG. 4 shows another variant of the apparatus shown in FIG. 1. In this case, the supply 6 is located to the bottom of the lower box 8 and the boxes in the distribution plate 9 are of sufficient size that the particles can pass through them. The lock passage 11 extends to below the distribution plate, so that the particles are transferred back to underneath the distribution plate. A cap 26 is fitted over the end of the supply pipe 6 so as to form, together with the free end of the supply pipe 6, a labyrinth path for the inflowing liquid. This prevents granules from flowing back into the supply 6. In this way, a wide distribution of the liquid medium and the particle mass is achieved in the box 8 so that a relatively uniform flow of the medium is achieved at the bores in the distribution plate 9. This leads to high efficiency since flow in the pipes 10 is more uniform.

The embodiments shown in FIGS. 2 and 3 can also be so modified that the return pipes 20 open beneath the distribution plate 9.

What is claimed is:

1. In apparatus for flow of a liquid medium, comprising a plurality of vertical pipes whose bottom and top ends open respectively into a bottom chamber and a top chamber, the bottom and top chambers being respectively connected to supply inlet and discharge outlet for the liquid medium whereby in operation the medium flows upwardly through the pipes, there being present in the apparatus a mass of particles fluidisable by the flow of said medium so as to occupy, in the fluidized state, at least said pipes the improvement of: transfer means adapted to transfer said particles batchwise from said top chamber to said bottom chamber without the creation, in the transfer means, of a direct connection between said top and bottom chambers.

2. Apparatus according to claim 1 wherein said transfer means includes separating means for separating the particles, which are to be transferred, from the said liquid medium.

3. Apparatus according to claim 1 wherein the transfer means is connected to the top chamber at a level above the said top ends of the pipes.

4. Apparatus according to any one of claims 1 to 3 wherein the transfer means is connected to the bottom chamber at or near the lowest level of the said fluidised particles in the bottom chamber during operation.

5. Apparatus according to claim 1 wherein the bottom chamber contains, below and spaced from the said lower ends of the pipes and above the supply inlet for the liquid medium, a horizontal flow distributor plate having apertures through it for the passage of the liquid medium and the particles, the transfer means being connected to the bottom chamber at a level below said distributor plate.

6. Apparatus according to claim 5 wherein the supply inlet is in the bottom of the bottom chamber and opens into the bottom chamber via a labyrinth passage.

7. Apparatus according to claim 1 wherein the transfer means includes at least one valve passage having first and second valves defining a lock chamber the first valve being openable to allow particles from the top chamber into the lock chamber and the second valve being openable to allow the particles to pass from the lock chamber to the bottom chamber.

8. Apparatus according to claim 7 wherein said transfer means has a plurality of said valve passages.

9. Apparatus according to claim 7 wherein in the or each valve passage said first valve is located above said second valve and both said valves have conical valve members, the conical valve member of the first valve tapering downwardly and the conical valve member of the second valve tapering upwardly.

10. Apparatus according to claim 9 wherein the said conical valve members of the first and second valves are mechanically linked for movement in concert by a valve rod extending through the lock chamber.

11. Apparatus according to any one of claims 7, 8 and 9 wherein said valve passage(s) extend(s) from the top chamber to the bottom chamber among the pipes.

12. Apparatus according to any one of claims 7, 8 and 9 wherein said valve passage(s) extend(s) from the top chamber to the bottom chamber away from the pipes.

13. Apparatus according to any one of claims 7, 8 and 9 wherein the or each valve passage is thermally insulated from the surroundings.

14. Apparatus according to any one of claims 7, 8 and 9 wherein the or reach valve passage widens in the direction from the top chamber to the bottom chamber.

15. Apparatus according to any one of claims 7, 8 and 9 wherein the or each valve passage has its inner surface formed of non-stick material.

16. Apparatus for flow of a liquid medium, comprising (a) a plurality of vertical pipes having top and bottom ends, (b) a top chamber into which said top ends of said pipes open, (c) a bottom chamber into which said bottom ends of said pipes open, (d) a supply inlet for the liquid medium connected to said bottom chamber, (e) a discharge outlet for the liquid medium connected to said top chamber, (f) a body of fluidisable particles adapted to be fluidized by the flow of said liquid medium so as to occupy at least said pipes during operation, and (g) transfer means adapted to effect batchwise transfer of said particles from the top chamber to the bottom chamber, without creating during such transfer, a direct connection in the transfer means between the top and bottom chambers.

* * * * *